US007473127B2

(12) United States Patent
Wang et al.

(10) Patent No.: US 7,473,127 B2
(45) Date of Patent: Jan. 6, 2009

(54) ELECTRICAL CONNECTOR

(75) Inventors: Chen-Xi Wang, Kunshan (CN); Hong-Qiang Han, Kunshan (CN); Zi-Qiang Zhu, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/150,385

(22) Filed: Apr. 28, 2008

(65) Prior Publication Data

US 2008/0268674 A1 Oct. 30, 2008

(30) Foreign Application Priority Data

Apr. 27, 2007 (CN) ..... 2007 2 0037202

(51) Int. Cl.
*H01R 13/60* (2006.01)

(52) U.S. Cl. ..... 439/541.5

(58) Field of Classification Search ..... 439/541.5, 439/79, 80

See application file for complete search history.

(56) References Cited

U.S. PATENT DOCUMENTS

| | | | | |
|---|---|---|---|---|
| 6,257,934 | B1 | 7/2001 | Gong et al. | |
| 6,264,501 | B1 * | 7/2001 | Hung et al. | 439/541.5 |
| 2005/0059296 | A1 * | 3/2005 | Wang | 439/541.5 |

* cited by examiner

*Primary Examiner*—Phuong K Dinh
(74) *Attorney, Agent, or Firm*—Wei Te Chung

(57) ABSTRACT

An electrical connector includes an insulative housing, a number of signal contacts retained in the insulative housing, a spacer positioned under the insulative housing, and a retainer fastening the insulative housing and the spacer together. The insulative housing has an upper face and a lower face opposite to the upper face. The spacer has a joint face engaging with the lower face and a mounting face opposite to the joint face. The retainer has a top wall affixing to the upper face and a locking barb engaging with the mounting face.

2 Claims, 7 Drawing Sheets

ELECTRICAL CONNECTOR

BACKGROUND OF THE INVENTION

1. Field of the Invention

The present invention relates to an electrical connector, and more particularly to an electrical connector having a spacer for adjusting the height of the electrical connector.

2. Description of Related Art

Electrical connectors are employed widely with peripherals to transmit various signals with each other. Usually, such electrical connector comprises an insulative housing and a plurality of signal contacts retained therein. The insulative housing defines a plurality of passageways for receiving the signal contacts. Each of the signal contacts has a contact section for connecting with a corresponding plug and a soldering section for connecting with a circuit board. Sometimes, a special electrical connector which is thicker than other common electrical connectors is required in a kind of peripheral. Therefore, the insulative housing and the signal contacts must be changed, and the molds used for forming the housing and the signal contacts must be accordingly adapted resulting in high production costs.

U.S. Pat. No. 6,257,934 discloses such an electrical connector which solves the above problems. The electrical connector comprises an insulative housing with a plurality of passageways, a plurality of signal contacts retained therein, a spacer positioned under the insulative housing and a plurality of connection contacts retained in the spacer. The insulative housing has opposite upper face and lower face. Each signal contact has an end portion extending through the passageways and out of the lower face. The spacer defines a plurality of receiving holes corresponding to the passageways respectively. The end portions extend into the receiving holes. Each connection contact has a connective portion received within the receiving holes to contact the end portion and a soldering portion extending out of the spacer. The insulative housing comprises a pair of locking elements extending integrally from lateral edges thereof. The spacer defines a pair of recesses being formed in side walls thereof for engaging with the locking elements to fasten the insulative housing and the spacer together.

According to above patent, the electrical connector having a different thickness can be formed with the existing connector, and need not to design a new mold. Therefore, the production costs can be decreased. Generally speaking, when the locking elements are much bigger, the fixation between the insulative housing and the spacer is much better. However, when the locking elements are big, it is very difficult to press them into the recesses and will not assure the assembly accuracy. When the locking elements are small, the spacer will disengage with the insulative housing easily. In fact, the size of the locking elements cannot be manufactured suitably too much and will result in a low quality.

Hence, an electrical connector is desired to overcome the disadvantage of the prior art.

BRIEF SUMMARY OF THE INVENTION

According to one aspect of the present invention, an electrical connector comprises an insulative housing, a plurality of signal contacts retained in the insulative housing, a spacer positioned under the insulative housing, and a retainer fastening the insulative housing and the spacer together. The insulative housing has an upper face and a lower face opposite to the upper face. The spacer comprises a joint face engaging with the lower face and a mounting face opposite to the joint face. The retainer comprises a top wall affixing to the upper face of the insulative housing and a locking barb engaging with the mounting face of the spacer.

According to another aspect of the present invention, an electrical connector comprises an insulative housing, a plurality of signal contacts retained in the insulative housing, a spacer positioned under the insulative housing and a retainer mounted to the insulative housing and the spacer. The insulative housing has an upper face, a lower face and a pair of side faces therebetween. The spacer comprises a joint face engaging with the lower face, a mounting face opposite to the joint face and a pair of side faces therebetween. A pair of locking blocks project outwardly from the side faces of the spacer. The retainer has a top wall affixing to the upper face and a pair of side walls affixing to the side faces of the insulative housing and the spacer. Each side wall defines a through hole engaging with the locking block.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Figure 1:
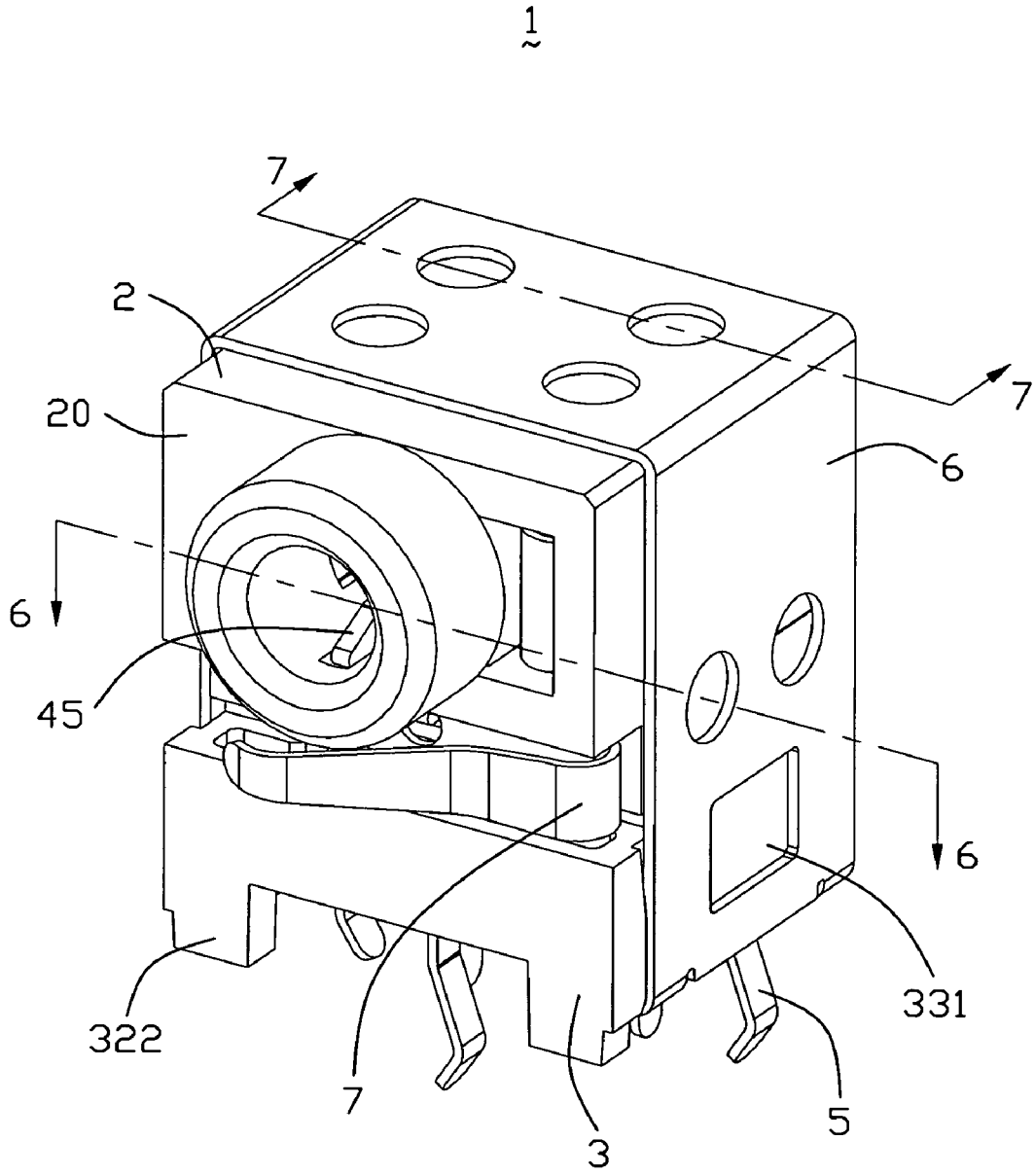
FIG. 1 is a perspective view of the preferred embodiment of an electrical connector according to the present invention.
Figure 2:
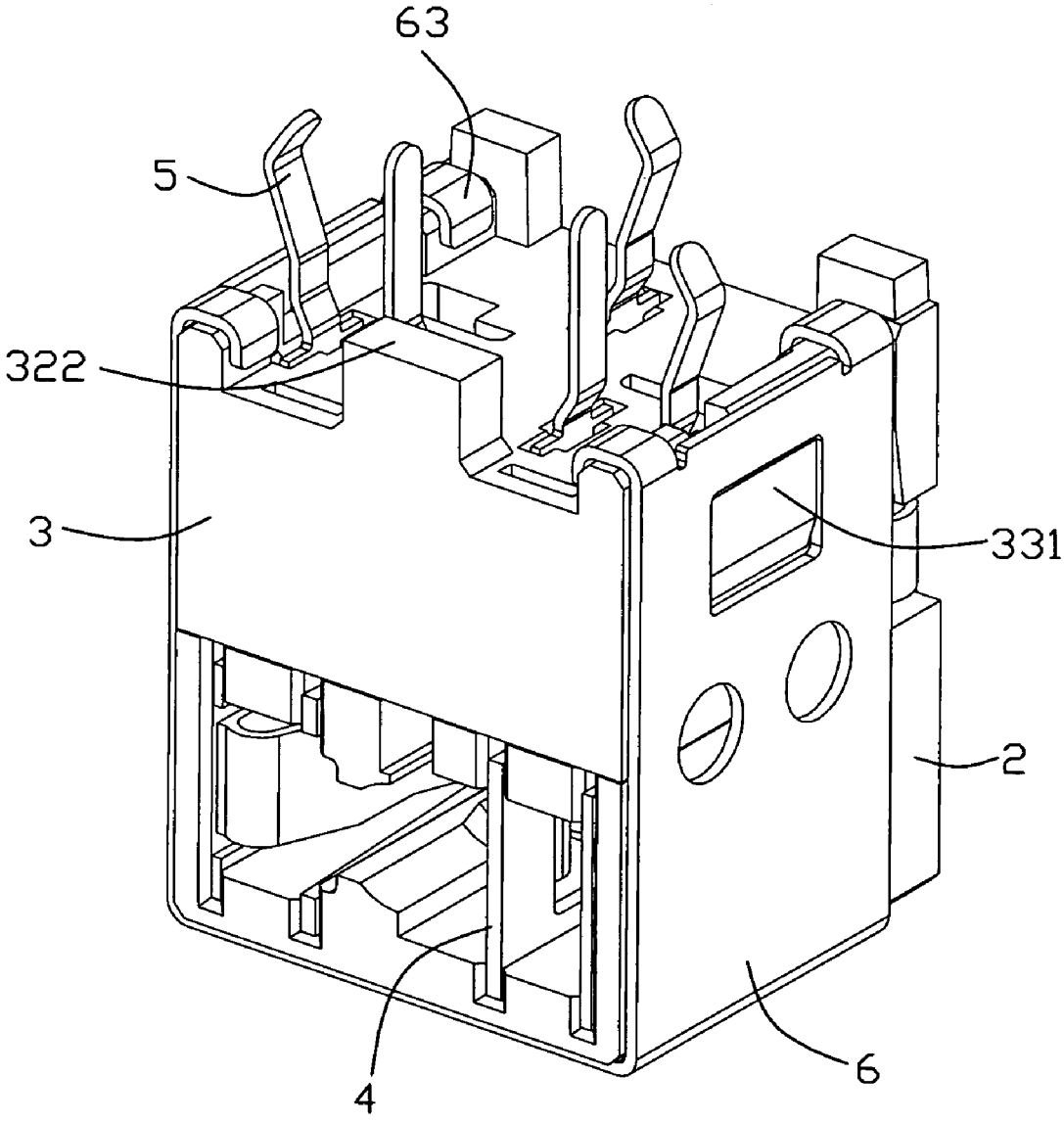
FIG. 2 is a view similar to FIG. 1, while taken from another aspect.
Figure 3:
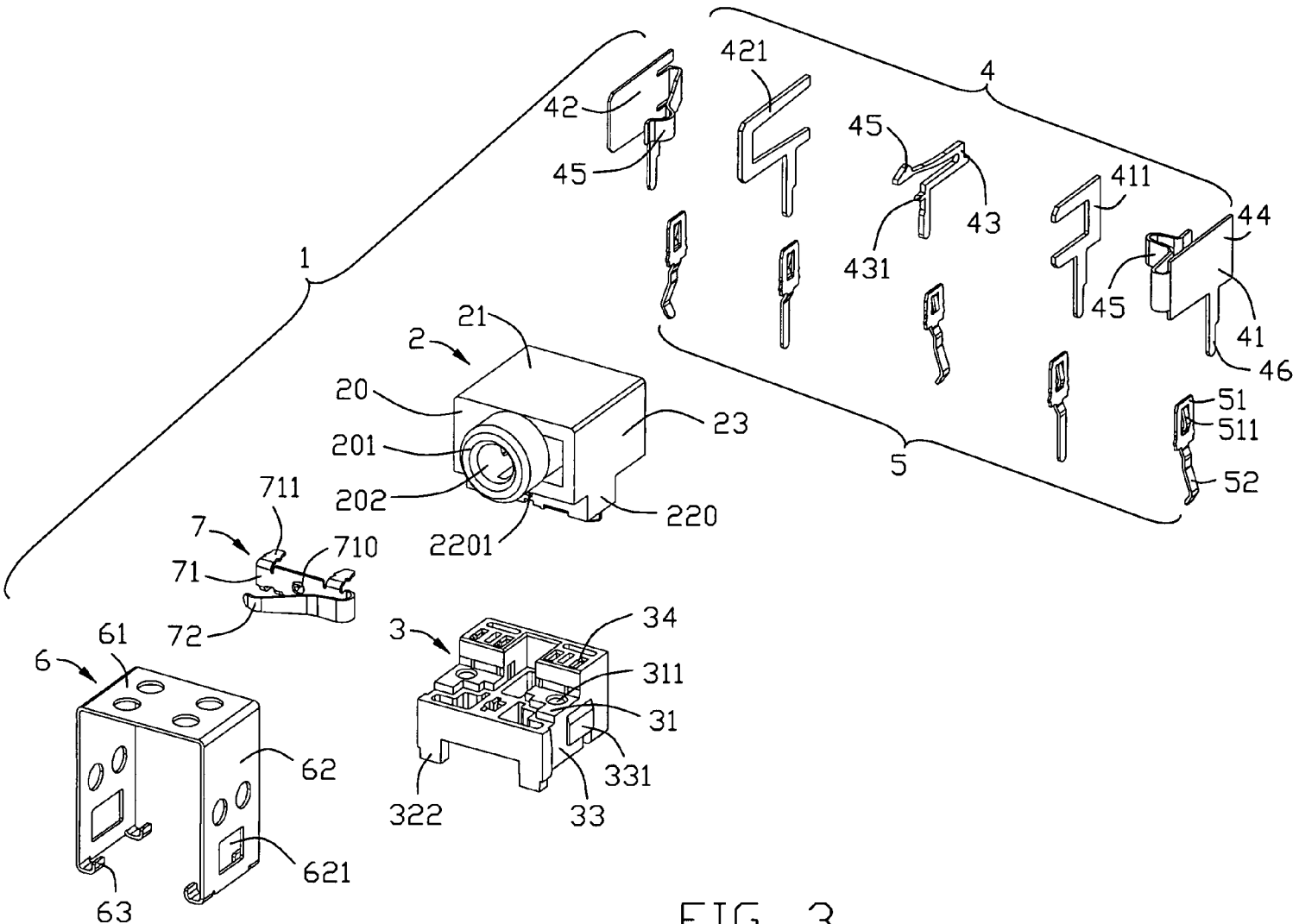
FIG. 3 is an exploded perspective view of the electrical connector shown in FIG. 1.
Figure 4:
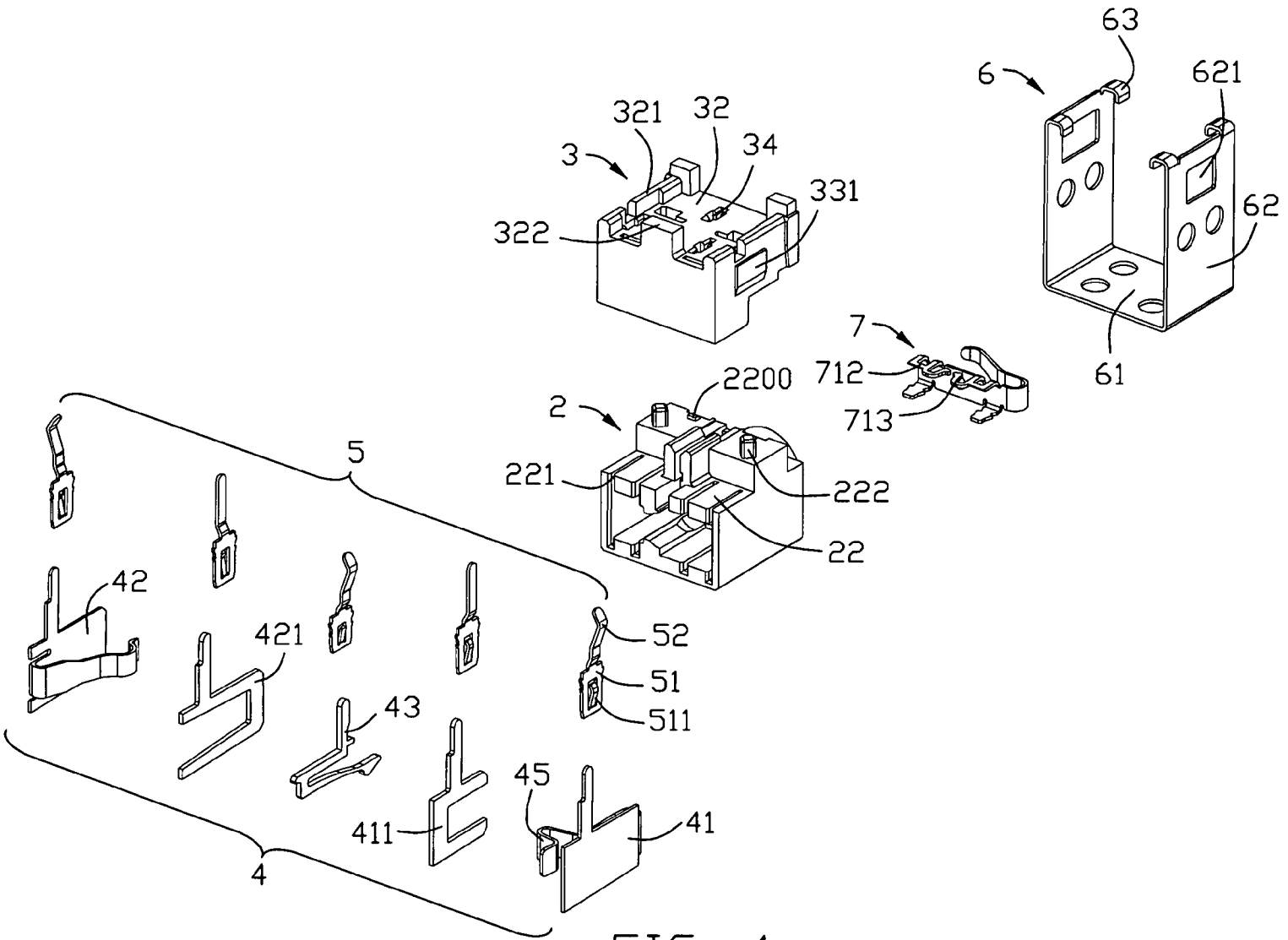
FIG. 4 is a view similar to FIG. 3, while taken from another aspect.
Figure 5:
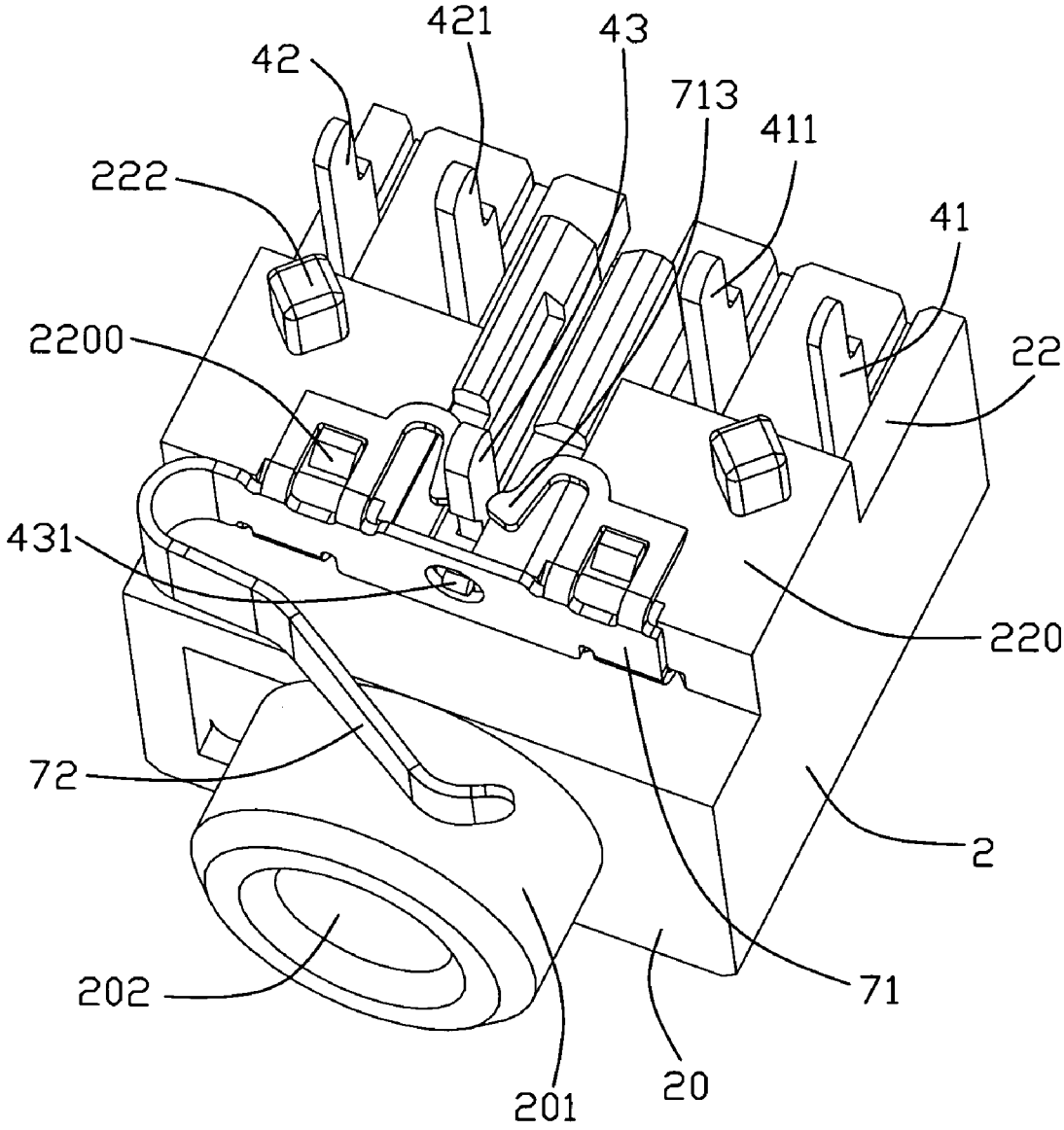
FIG. 5 is a perspective view of an insulative housing of the electrical connector.
Figure 6:
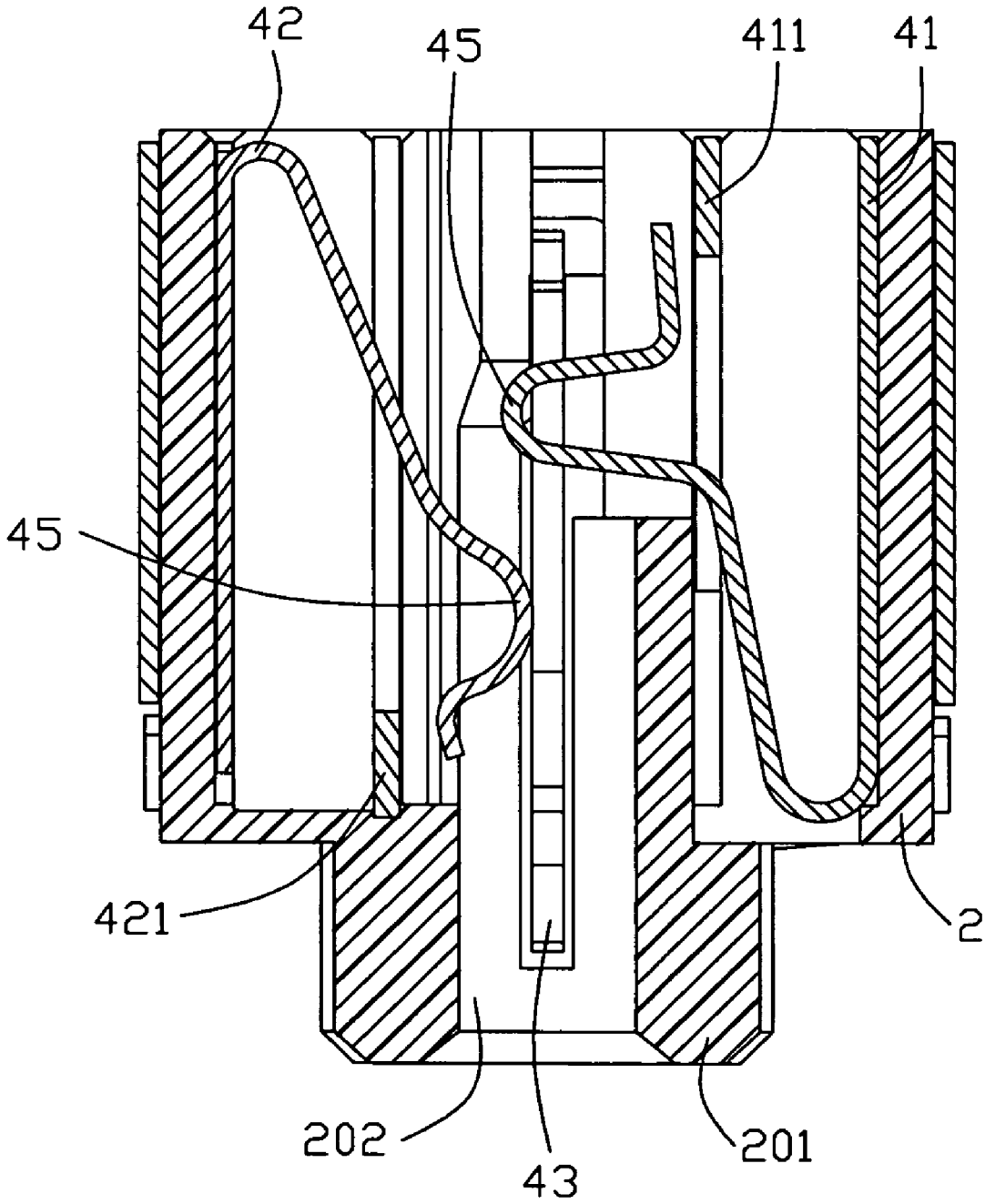
FIG. 6 is a cross-sectional view taken along line 6-6 of FIG. 1.
Figure 7:
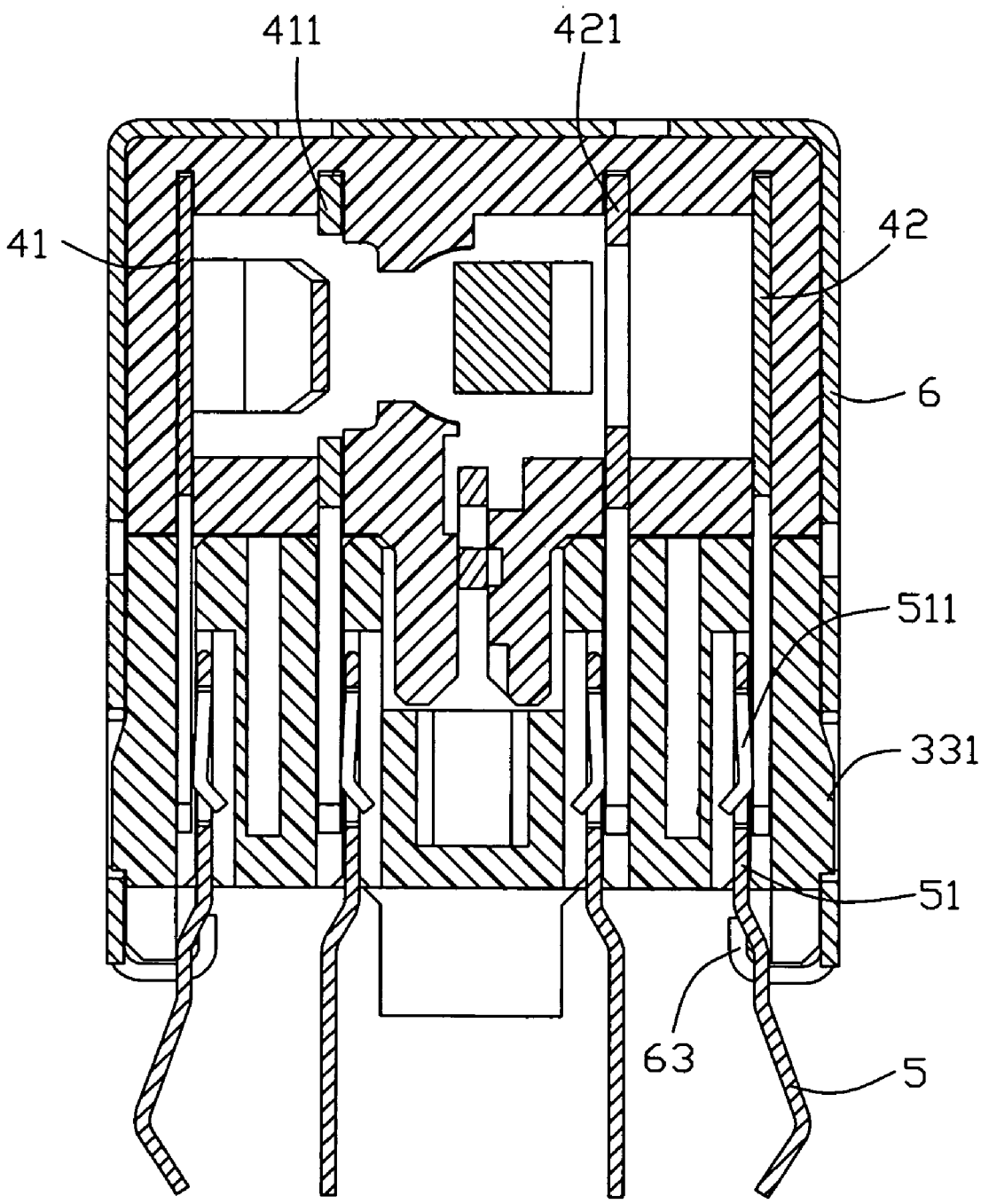
FIG. 7 is a cross-sectional view taken along line 7-7 of FIG. 1.

Referring to FIGS. 1-5, an electrical connector 1 for receiving a corresponding plug (not shown) is disclosed in accordance with the present invention. The electrical connector 1 comprises an insulative housing 2, a spacer 3 positioned under the insulative housing 2, a plurality of signal contacts 4 and connection contacts 5 retained in the insulative housing 2 and the spacer 3, a retainer 6 fastening the insulative housing 2 and the spacer 3 together, and a spring arm 7 for abutting against a panel (not shown).

The insulative housing 2 has a mating face 20, an upper face 21 perpendicular to the mating face 20, a lower face 22 opposite to the upper face 21 and a pair of side faces 23. An insert section 201 projects forwardly from the mating face 20. The insert section 201 presents as cylinder shaped and defines a receiving cavity 202 extending through the insulative housing 2 along a front to back direction for receiving the corresponding plug. A projection 220 projects downwardly from the lower face 22 and locates near the mating face 20. The projection 220 comprises a pair of recesses (not labeled) extending inwardly from a front end thereof for retaining the spring arm 7, and a pair of protrusions 2200 located at a lower end thereof. The insulative housing 2 defines a plurality of passageways 221 extending through the lower face 22 and the receiving cavity 202. The projection 220 defines a hollow 2201 extending from the front end thereof and communicated with the passageway 221. The projection 220 has a post 222 extending downwardly therefrom.

The spring arm 7 has a securing section 71 positioned on the front end of the projection 220 and an elastic contact section 72 bending from the securing section 71 for abutting against the panel. The securing section 71 comprises a hole 710 corresponding to the hollow 2201, a pair of fastening strips 711 and a pair of latching portions 712 extending rearwardly from two sides thereof respectively. The fastening strips 711 are received in the recesses. The latching portions 712 engage with the protrusions 2200. Each latching portion 712 has an engaging portion 713 to contact with the signal contacts 4 for grounding.

The spacer 3 is positioned under the insulative housing 2 for increasing the height of the insulative housing 2. The spacer 3 and the insulative housing 2 are configured to have a similar width. The spacer 3 has a joint face 31 engaging with the lower face 22 of the insulative housing 2, a mounting face 32 opposite to the joint face 31 and two side faces 33. The spacer 3 defines a plurality of receiving holes 34 extending through the joint face 31 and the mounting face 33, and a mating hole 311 for receiving the post 222. The receiving holes 34 are arranged in alignment with the passageways 221 of the insulative housing 2. The post 222 is received in the mating hole 311 for avoiding the spacer 3 or the insulative housing 2 moving in a horizontal direction. The spacer 3 has a pair of locking blocks 331 extending outwardly from two side faces 33 thereof respectively. A pair of ribs 321 extend downwardly from two sides of the mounting face 32. The spacer 3 comprises four mounting legs 322 for positioning on a circuit board (not shown).

The signal contacts 4 comprise first and second movable contacts 41, 42 arranged at two sides of the insulative housing 2, first and second fixing contacts 411, 421 arranged at inside of the first and second movable contacts 41, 42, and a ground contact 43 connecting with the spring arm 7 for grounding. Each signal contact 4 has a retaining portion 44 engaging with the passageway 221 and an end portion 46 extending out of the lower face 22 and inserting into the receiving hole 34 of the spacer 3 for electrically connecting with the connection contact 5. Each of the first and second movable contacts 41, 42 and the ground contact 43 has an elastic contact portion 45 extending into the receiving cavity 202 for connecting with the corresponding plug. The ground contact 43 has a positioning portion 431. After the ground contact 43 is assembled in the insulative housing 2, the positioning portion 431 extends through the hollow 2201 of the projection 220 and the hole 710 of the spring arm 7 for ensuring good position. The engaging portion 713 of the spring arm 7 contacts with the ground contact 43 for grounding.

Before the plug inserts into the electrical connector 1, the first movable contact 41 is separate from the first fixing contact 411, and the second movable contact 42 is separate from the second fixing contact 421. After the plug inserts into the electrical connector 1, the elastic contact portions 45 of the first and second movable contacts 41, 42 and the ground contact 43 electrically contact corresponding parts of the plug. Therefore, the first movable contact 41 electrically contacts the first fixing contact 411, and the second movable contact 42 electrically contacts the second fixing contact 421.

The connection contacts 5 are assembled in the receiving holes 34 of the spacer 3. Each connection contact 5 comprises a retaining portion 51 received in the receiving hole 34 and a soldering portion 52 extending out of the spacer 3. The retaining portion 51 has a contact portion 511 for electrically contacting with the signal contact 4. Therefore, the contacts of the present invention can be formed with existing contacts and the connection contacts 5, and need not to design a new mold. The cost of the production can be decreased.

The retainer 6 is made of a metal sheet, and comprises a top wall 61 affixing to the upper face 61 and two side walls 62 extending downwardly. The side walls 62 affix to the side faces 23, 33 of the insulative housing 2 and the spacer 3. Each side wall 62 defines a locking hole 621 for engaging with the locking block 331 of the spacer 3 and a pair of locking barbs 63 extending inwardly from a lower end thereof for locking with the ribs 321 of the spacer 3. Therefore, the retainer 6 fastens the insulative housing 2 and the spacer 3 together firmly.

According to the present invention, the spacer 3 can be suitably formed to provide the electrical connector 1 with a required height. Thus, the production cost is reduced by eliminating the necessity of manufacturing another electrical connector. In addition, the retainer 6 is produced by a metal sheet and has a brief structure. Therefore, the retainer 6 has a good elasticity and can fasten the insulative housing 2 and the spacer 3 firmly. It is noted that because the signal contacts uses relative much material along the front-to-back direction, it saves material when using connection contacts 5 to connect the signal contacts 4 to the printed circuit board in the vertical direction, in comparison with using unitary contacts having a full dimension in the vertical direction.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. An electrical connector, comprising:

an insulative housing comprising an upper face and a lower face opposite to the upper face;

a plurality of signal contacts retained in the insulative housing;

a spacer positioned under the insulative housing and having a joint face engaging with the lower face and a mounting face opposite to the joint face; and a retainer fastening the insulative housing and the spacer together, the retainer having a top wall affixing to the upper face of the insulative housing and a locking barb engaging with the mounting face of the spacer wherein the insulative housing and the spacer are configured to have a similar width, and wherein the insulative housing and the spacer each has a pair of side faces, the retainer having a pair of side walls affixing to the side faces, wherein the locking barb is extended inwardly from a lower end of the side wall, wherein the insulative housing comprises a mating face and an insert section projecting forwardly therefrom, the insert section presenting as cylinder shaped and defining a receiving cavity extending therethrough, wherein the insulative housing comprises a post extending downwardly from the lower face, the spacer defining a mating hole for receiving the post, wherein the insulative housing defines a plurality of passageways for receiving the signal contacts, wherein each signal contact has an end portion extending downwardly through the passageway and out of the lower face, wherein the spacer defines a plurality of receiving holes in alignment with the passageways respectively, and wherein the end portions are received in the receiving holes and further comprising a plurality of connection contacts received in the receiving holes for mechanically and electrically engaging with the end portions of the signal contacts, each connection contact having a soldering portion extending out of the mounting face.

2. An electrical connector, comprising:

an insulative housing comprising an upper face, a lower face and a pair of side faces therebetween;

a plurality of signal contacts retained in the insulative housing;

a spacer positioned under the insulative housing, the spacer having a joint face engaging with the lower face, a mounting face opposite to the joint face, and a pair of side faces therebetween, a pair of locking blocks each projecting from the side faces of the spacer; and a retainer assembled to the insulative housing and the spacer, the retainer having a top wall affixing to the upper face and a pair of side walls affixing to the side faces of the insulative housing and the spacer, each side wall defining a through hole engaging with the locking block, wherein the spacer has a pair of ribs extending downwardly from two sides of the mounting face, wherein the retainer has a plurality of locking barbs extending inwardly from a lower end of the side walls thereof for locking with the fibs, wherein the insulative housing and the spacer are configured to have a similar width, wherein the insulative housing comprises a post extending downwardly from the lower face, the spacer defining a mating hole for receiving the post, wherein the insulative housing defines a plurality of passageways for receiving the signal contacts, the spacer defining a plurality of receiving holes in alignment with the passageways respectively, wherein each signal contact has an end portion extending into the receiving holes, and further comprising a plurality of connection contacts received within the receiving holes for mechanically and electrically engaging with the end portions of the signal contacts, each connection contact having a soldering portion extending out of the mounting face.

* * * * *